US005421170A

United States Patent [19]

Södervall

[11] Patent Number: 5,421,170

[45] Date of Patent: Jun. 6, 1995

[54] ARRANGEMENT RELATING TO REFRIGERATOR AND FREEZER GONDOLAS

[75] Inventor: Sven E. Södervall, Edane, Sweden

[73] Assignee: Termofrost AB, Kista, Sweden

[21] Appl. No.: 142,349

[22] PCT Filed: May 21, 1992

[86] PCT No.: PCT/SE92/00343

§ 371 Date: Nov. 23, 1993

§ 102(e) Date: Nov. 23, 1993

[87] PCT Pub. No.: WO92/21271

PCT Pub. Date: Dec. 10, 1992

[30] Foreign Application Priority Data

May 30, 1991 [SE] Sweden ..... 9101641

[51] Int. Cl.[6] ..... A47F 3/04

[52] U.S. Cl. ..... 62/249; 62/264; 312/116

[58] Field of Search ..... 62/249, 246, 264; 312/114, 116

[56] References Cited

U.S. PATENT DOCUMENTS

| | | | |
|---|---|---|---|
| 2,093,728 | 9/1937 | King | 62/249 |
| 2,644,736 | 7/1953 | Atchison | 62/249 X |
| 2,655,419 | 10/1953 | Achs | 62/249 X |
| 4,572,598 | 2/1986 | Moore, Jr. | 62/246 X |
| 4,580,693 | 4/1986 | Frechet | 220/240 |
| 5,082,334 | 1/1992 | Beyer et al. | 312/140.4 |

FOREIGN PATENT DOCUMENTS

| | | |
|---|---|---|
| 0114017 | 7/1984 | European Pat. Off. . |
| 0406200 | 1/1991 | European Pat. Off. . |
| 3620948 | 1/1988 | Germany . |
| 3733726 | 4/1989 | Germany . |
| 451940 | 11/1987 | Sweden . |

*Primary Examiner*—William E. Tapolcai
*Attorney, Agent, or Firm*—Philip E. Kurz; Nies, Kurz, Bergert & Tamburro

[57] ABSTRACT

An arrangement pertaining to refrigerator and freezer gondolas of the kind used to exhibit merchandise in self-service retail stores and being upwardly open in order to expose refrigerated and frozen merchandise. The invention has an upper glass plate located above the opening of the gondola. The size and positioning of the glass plate is such as to generally cover the gondola opening, seen in vertical projection. The surface of the glass plate facing towards the gondola opening is provided with an infrared reflecting layer having an emissivity number below 0.2, preferably below 0.1.

14 Claims, 1 Drawing Sheet

ARRANGEMENT RELATING TO REFRIGERATOR AND FREEZER GONDOLAS

The present invention relates to an arrangement pertaining to refrigerator and freezer gondolas, for displaying merchandise in self-service, retail stores.

The tops of such gondolas are left open, without the provision of a lid or corresponding device. It will be obvious that large quantities of heat flow into the gondolas and that this heat is cooled by the gondola refrigerating machine. This makes the gondolas relatively expensive to run. Although a lid or like device would reduce refrigeration load on the gondola, the gondola would have far less attraction to the customer. In order to reduce the extent to which heat enters the gondolas when the stores are closed, it is usual to cover the gondolas with a covering of woven plastic for instance. However, this will only prevent the ingress of convection heat.

The present invention reduces the exchange of heat between the merchandise in the gondola and the surroundings effectively, even during store opening times when the gondola is used as intended.

The present invention thus relates to an arrangement pertaining to refrigerator and freezer gondolas of the kind used to display merchandise in self-service retail stores and which are upwardly open and with a cover over and spaced above the opening of the gondola so as to expose the refrigerated or frozen sales merchandise, the invention being characterized in that there is mounted above the gondola opening an upper glass plate which has a size and position such as to essentially cover the gondola opening as seen in vertical projection; and in that the glass plate is provided on that surface thereof which faces towards the gondola opening with an infrared reflecting layer having an emissivity number or factor below 0.2, preferably 0.1

The invention will now be described in more detail with reference to exemplifying embodiments thereof and with reference to the accompanying drawings, in which FIG. 1 is a side view of a gondola with which the invention is applied;

FIGS. 1 and 2 illustrate a refrigerator or freezer gondola 1 of the kind used to exhibit merchandise in self-service retail stores, the gondola being open upwardly so as to expose the refrigerated or frozen merchandise on sale and so as to enable the customer to remove merchandise readily from the gondola. Such gondolas are extremely common and can be found in many different sizes and designs.

Figure 1:
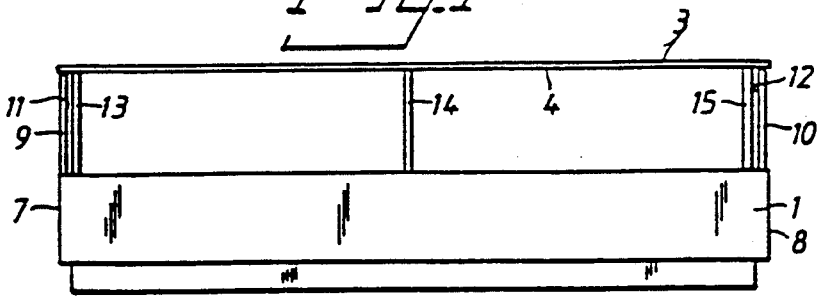

According to the present invention, an upper glass plate 3 is mounted above the access opening 2 of the gondola 1. The glass plate 3 has a size and positioning such as to generally cover the gondola opening 2, as seen in vertical projection. According to one preferred embodiment of the invention, the glass plate 3 has a width which exceeds the width of the gondola opening 2, preferably, by from 20 to 50%. The length of the glass plate equals the length of the gondola, although it may alternatively be slightly longer.

According to the invention, the surface 4 of the glass plate 3 facing towards the gondola opening 2 is provided with an infrared reflecting coating 5 having an emissivity number or factor of below 0.2, preferably below 0.1.

Figure 6:
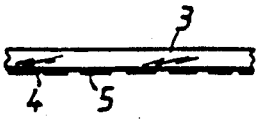
FIG. 6 illustrates part of a glass plate.

FIG. 6 illustrates a part of a glass plate 3, in which the infrared reflecting layer 5 is shown in broken lines.

By arranging a glass plate in this way and providing the glass plate with an infrared reflecting layer of low emissivity factor, the radiation exchange between the merchandise in the gondola and the surroundings is greatly reduced. Because of the low emissivity factor, the radiant efficiency between the undersurface of the glass plate and the merchandise will be very low, while heat radiated from ceiling light fittings, among other things, will be reflected back to the ceiling by the infrared reflecting layer 5.

However, an exchange of heat will take place by radiation between the merchandise and that part of the surroundings which can "be seen" by the merchandise in that sector delimited by the glass plate and the upper edge 6 of the gondola. This sector can be made smaller or larger, by varying the height of the glass plate above the gondola and the width of the plate. The glass plate is preferably placed at the lowest possible height in which it will not be felt to be in the way of the customers as they remove merchandise from the gondola, despite being wider than the width of the gondola.

Figure 3:
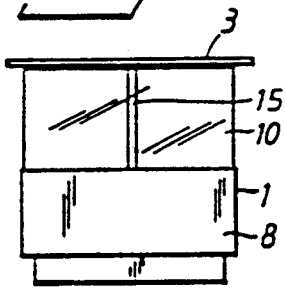
FIG. 3 illustrates a modified form of the gondola shown in FIG. 2.

According to one preferred embodiment, illustrated in FIGS. 1 and 3, glass end plates 9, 10 are mounted vertically at the ends 7, 8 of the gondola, between the upper side of the gondola and the underside 4 of the upper glass plate 3. The surfaces 11, 12 of these glass end plates 9, 10 fitted to the gondola are provided with an infrared reflecting coating having an emissivity number, or factor, beneath 0.2, preferably beneath 0.1. These glass end plates will further reduce the sector within which an exchange of heat can take place between the merchandise and the surroundings by radiation.

The invention thus minimizes the exchange of radiant heat between the merchandise and the surroundings. This heat exchange is dominating, particularly in the case of freezer gondolas. Less heat is exchanged by convection. Consequently, it is found that the amount of energy that needs to be supplied to the gondola refrigerator machine is significantly reduced when applying the present invention, despite the fact that the gondola is open and despite the fact that the upper glass plate does not eliminate all exchange of radiant heat. This reduction in energy supply may equal roughly half of the energy that is required when the invention is not applied.

Figure 2:
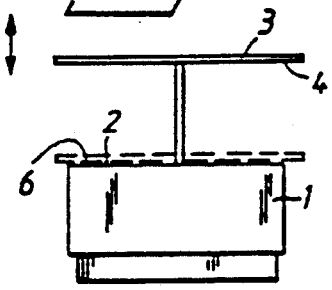
FIG. 2 shows the gondola of FIG. 1 from its short end.

According to a further, preferred embodiment of the invention, the upper glass plate 3 can be raised to an upper position, shown in full lines in FIG. 2, and lowered to a lower position, shown in broken lines in FIG. 2, in which it is located immediately above the gondola opening or, alternatively, lies against the upper edges of the gondola. This construction enables the glass plate to be lowered readily, so as to cover the gondola opening during those times in which the store is closed. When the glass plate is lowered to its lower position, the exchange of both convection heat and radiant heat between merchandise and surroundings is prevented. This results in a very low degree of heat exchange. Furthermore, it also results in a considerable improvement compared with the known technique in which the gondolas are covered with a sheet of material. These coverings have a high emissivity factor, namely an emissivity factor close to 1, and hence the exchange of radiant heat is still high.

According to one embodiment, the upper glass plate 3 is supported by posts 13, 14, 15 attached to the gondola. Known gondolas are often fitted with such posts for supporting a shelf on which merchandise to be stored at room temperature is displayed. Naturally, corresponding posts can be used to support the glass plate 3.

According to one preferred embodiment, the glass plate 3 is constructed to form such a shelf for the display of merchandise stored at room temperature.

When the upper glass plate is to be supported in a manner which will enable the plate to be raised and lowered, as before mentioned, the aforesaid posts 13, 14, 15 may be constructed in a manner to enable them to be moved vertically in relation to the gondola. This can be achieved, for example, with the aid of ball screws driven by electric motors and acting between the gondola and respective posts. This would also enable raising and lowering of the glass plate to be controlled by electrical timers of known kind and effected at appointed times.

Figure 4:
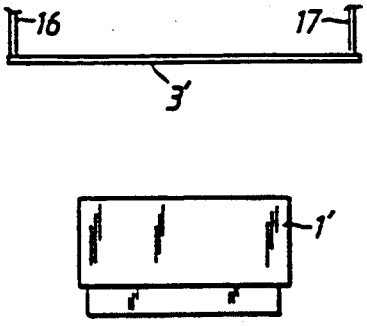
FIG. 4 illustrates an alternative embodiment of the invention.

According to one alternative embodiment of the invention, the upper glass plate 3' is supported by ties or braces 16, 17 or by wires attached to the ceiling of the store concerned; see FIG. 4 in which only a part of the braces are shown. In this case, the glass plate 3' suspended from the ceiling coacts with a gondola 1' positioned beneath the glass plate 3'. In the case of this embodiment, the glass plate can be placed in the same position relative to the gondola as in the case where the glass plate is supported by posts. As will be understood, the glass plate can be made raisable and lowerable, as before described.

Although mention has been made in the aforegoing to a glass plate, it will be understood that in the case of large gondolas, the upper glass plate will, of necessity, include two or more glass plates placed adjacent one another. These glass plates are secured to a common structure, such as a framework, which in turn is supported by posts 13, 14, 15 or braces 16, 17.

Figure 5:
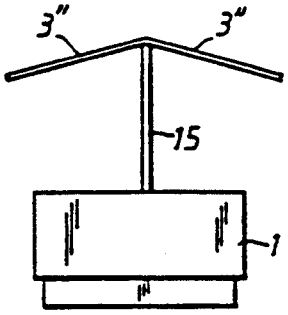
FIG. 5 illustrates a modified form of the invention.

In the foregoing, embodiments have been described in which the glass plate 3 is flat and horizontal. It is also possible, however, to incline a flat glass plate or to position two glass plates 3'' so as to form a pitched roof structure, as illustrated in FIG. 5.

Figure 7:
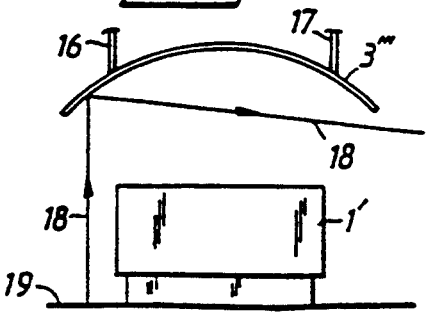
FIG. 7 illustrates another modified embodiment of the invention.

Furthermore, according to one preferred embodiment of the invention, the glass plate ''' can be arched over the gondola 1', in the manner illustrated in FIG. 7, in which the glass plate is supported by braces or ties 16, 17 or wires. It is possible to prevent radiation 18 from the floor 19 being reflected into the interior of the gondola by the infrared reflecting layer, by appropriate selection of the radius of curvature of the glass plate and its height above the gondola. This is illustrated by the rays 18 arrowed in FIG. 7. This construction thus prevents the radiation of heat into the gondola still further.

Although the invention has been described above with reference to a number of embodiments thereof, it will be understood that further variants are possible. For example, the glass plate can be secured to the underside of a shelf made of metal or some other material. In this case, no benefit is gained by the transparency of the glass and the only benefit afforded is that the surface facing towards the merchandise has a low emissivity number. The glass late of this construction can also be made raisable and lowerable.

The present invention is therefore not restricted to the aforedescribed and illustrated embodiments thereof, since variations and modifications can be made within the scope of the following claims.

I claim:

1. An arrangement pertaining to refrigerator and freezer gondolas of the kind used to display merchandise in self-service retail stores, the gondola being open upwardly and having a cover located above and at a vertical distance from the opening of the gondola, in order to expose the refrigerated and frozen merchandise, the improvement comprising an upper glass plate (3; 3'; 3'', 3''') located above the opening (2) of the gondola (1), said glass plate having a size and position such as to provide a cover over the gondola opening (2) as seen in vertical projection; and the surface (4) of the glass plate (3; 3'; 3'', 3''') facing towards the gondola opening (2) being provided with an infrared reflecting layer having an emissivity number below 0.2.

2. An arrangement according to claim 1, wherein the width of the glass plate (3; 3'; 3''; 3''') exceeds the width of the gondola opening (2).

3. An arrangement according to claim 1, wherein there is an end wall at each end of the gondola and glass end plates are arranged adjacent the end walls (7, 8) of the gondola (1) and said glass end plates extend vertically between the upper side (6) of the gondola (1) and the underside (4) of said upper glass plate (3; 3': 3'', 3'''), and wherein the surfaces (11, 12) of said glass end plates (9, 10) which face in towards the gondola are provided with an infrared reflecting layer having an emissivity number below 0.2.

4. An arrangement according to claim 1, wherein means are provided enabling the upper glass plate (3; 3'; 3'', 3''') to be raised to an upper position and lowered to a lower position in which it is located immediately adjacent the gondola opening (2).

5. An arrangement according to claim 1, wherein posts are attached to the gondola and are connected to and support the upper glass plate (3; 3'').

6. An arrangement according to claim 1, wherein the upper glass plate (3', 3''') is supported by suspension means attached to the store ceiling.

7. An arrangement according to claim 1, wherein the upper glass plate (3; 3') provides a shelf for supporting merchandise to be displayed and stored at room temperature.

8. An arrangement according to claim 1, wherein the upper glass plate (3; 3'; 3'', 3''') comprises two or more glass plates placed laterally adjacent one another.

9. An arrangement according to claim 1, wherein the upper glass plate (3''') comprises a curved glass structure positioned over the gondola.

10. An arrangement as defined in claim 1 wherein said infrared reflecting layer has an emissivity number below 0.1.

11. An arrangement according to claim 1, wherein the width of the glass plate exceeds the width of the gondola opening by a value within the range of 20 to 50%.

12. An arrangement as defined in claim 3, wherein said infrared reflecting layer on said glass end plates has an emissivity number below 0.1.

13. An arrangement as defined in claim 4, wherein the gondola opening has peripheral edges and said upper glass plate in its lower position is located against the edges of said gondola opening.

14. An arrangement as defined in claim 6, wherein said suspensions means are selected from a group of suspension devices consisting of braces, ties and wires.

* * * * *